United States Patent [19]

Steele

[11] Patent Number: 4,892,426

[45] Date of Patent: Jan. 9, 1990

[54] PAPER MOVEMENT MONITOR

[75] Inventor: David Steele, Edinburgh, Scotland

[73] Assignee: Unisys Corporation, Blue Bell, Pa.

[21] Appl. No.: 213,857

[22] Filed: Jun. 30, 1988

[51] Int. Cl.[4] ..... B41J 11/64

[52] U.S. Cl. ..... 400/708; 226/45; 226/100; 226/23; 250/548; 250/560; 101/226; 271/227; 271/259; 271/261

[58] Field of Search ..... 400/708, 708.1; 101/226, 248; 271/227, 259, 261, 265; 226/17, 23, 45, 11, 100; 250/548, 559–561

[56] References Cited

U.S. PATENT DOCUMENTS

| | | | |
|---|---|---|---|
| 3,081,700 | 3/1963 | Kieckhefer, Jr. | 101/248 |
| 3,147,898 | 9/1964 | Huck | 226/45 |
| 3,323,700 | 6/1967 | Epstein et al. | 226/45 |
| 3,521,880 | 7/1970 | Shebanow et al. | 271/227 |
| 3,858,052 | 12/1974 | Lusua | 101/248 |
| 3,917,142 | 11/1975 | Guarderas | 226/45 |
| 4,212,419 | 7/1980 | Huber | 226/23 |
| 4,216,482 | 8/1980 | Mason | 271/227 |
| 4,370,665 | 1/1983 | Scranton et al. | 400/704 |
| 4,530,613 | 7/1985 | Horman et al. | 400/708 |
| 4,545,031 | 10/1985 | Kobayashi | 271/227 |

FOREIGN PATENT DOCUMENTS

| | | | |
|---|---|---|---|
| 2847619 | 5/1979 | Fed. Rep. of Germany | 400/708 |
| 153755 | 9/1984 | Japan | 226/45 |
| 222370 | 12/1984 | Japan | 400/708 |
| 167838 | 8/1985 | Japan | 271/227 |
| 2017058 | 9/1979 | United Kingdom | 271/227 |

OTHER PUBLICATIONS

UK Patent Application GB 2187318 A, Published 9/3/87.

"Sheet Aligner", IBM Tech. Disclosure Bulletin, vol. 18, No. 5, Oct./75, pp. 1.307–1.308.

*Primary Examiner*—Eugene H. Eickholt

*Attorney, Agent, or Firm*—Mark T. Starr

[57] ABSTRACT

A monitor (18,26,28) monitors movement of paper (12) through a printer (16). The paper movement sensors (18,26) comprise one central wheel (70) or a pair of spaced edge wheels (158) each operating an individual photo-optic wheel (164,76). By counting pulses from the photo-optic wheels (76,164) monitor logic (28) determines conditions of jam, over-feeding and skew within the printer (16) both on an instantaneous and on a short term cumulative basis. The system self-calibrates through an initializing routine and later, continuously during operation. Paper movement sensors (18,26) are provided in dust-protected housings which can be chained together to provide monitoring facilities at many points.

27 Claims, 8 Drawing Sheets

PAPER MOVEMENT MONITOR

BACKGROUND OF THE INVENTION

The present application relates to an apparatus for monitoring the movement of paper in a printing apparatus. It particularly relates to use with a printer for printing upon a continuous paper web.

A continuous paper web is generally provided in printing in the form of a roll of paper. Printers upon paper rolls is used in many applications. In financial machines such as autotellers and check sorting machines a concealed printer is generally provided to keep a visible record of transactions made or recorded. Concealed printers are also to be found in cash registers, electronic analyzing equipment, compact electronic graph plotters, chart recorders and the like. The present invention is particularly directed towards detecting paper movement problems in concealed printers where opertor oversight is not available.

The general function of any printing machine is to cause a printing device to produce a line of printing. Thereafter the paper web is advanced by the distance of one or more line spacings and the printing head once again executes a line of printing. In the past monitors have relied upon electrical signalling between the printer and the monitor itself in order to indicate when the paper should be executing a line advance. The present invention seeks to improve over this situation by providing that the monitor is reliant for its function only upon paper movement and not in any subservient way upon the actions of the printer. The present invention thereby seeks to achieve a true add-on capability for such a monitor irrespective of the type of printer employed.

SUMMARY OF THE INVENTION

The present invention consists in an apparatus for monitoring movement of paper in a printer, said apparatus comprising a first movement sensor operative to engage paper in a printer at a first point and operative to detect the distance moved by the paper at said first point between successive lines of printing, said apparatus providing indication of a paper feed error if said distance of movement detected by said first sensor does not lie within first and second predetermined limits.

One preferred embodiment of the present invention provides rolling means for rolling against the paper and a rotation detection means for detecting rotation of the rolling means. If the rolling means has not rotated through at least a predetermined distance, but no greater than another predetermined distance, during a first time period after detection of first movement, no paper movement error is flagged or indicated. If the detected movement is too short or too long during the period of movement the appropriate error is indicated. Should any paper movement be detected during a second period when printing should take place, a spurious paper movement is indicated.

Printers typically have a paper input point and a paper output point. Should any malfunction occur within the printer causing paper tearing or paper accumulation, simple prior art paper movement monitors will not detect the condition. The present invention seeks to provide added utility by including in the apparatus a second movement sensor operative to engage the paper in a printer at a second point and operative to detect the distance moved by the paper at said second point between successive lines of printing. The apparatus being operative to make a first sum of the distance detected by the first sensor, to make a second sum of the distance detected by the second sensor, and to provide indication of paper accumulation if the difference between the first sum and the second sum exceeds a predetermined magnitude.

It is a problem when using a pair of devices rolling against paper that manufacturing tolerances ensure that it is virtually impossible to find two rolling devices having the same diameter and thus the same sensitivity to paper movement when their respective rotations are summed. Accordingly the present invention provides that the first sensor has a first rolling means for rolling on the advancing paper and a first rotation detection means for providing an output indicative of the angular movement of the first rolling means. The second sensor has a second rolling means for rolling on the paper and second rotation detection means for providing an output indicative of the angular movement of the second rolling means. The apparatus self-calibrates by making a sum of the output of the first rotation detection means, by making a sum of the output of the second rotation detection means, and by finding the ratio between the sums of the outputs of the first and second rotation detection means to establish an advance ratio. The present invention further provides for multiplying the sum of the output of the first or second rotation detection means by the advance ratio to normalize the outputs of the first and second rotation detection means to have the same sensitivity to paper movement.

The present invention further provides for the formation of a long term value of the advance ratio, based on paper movement through a first number of lines of printing; and the formation of a short term value of the advance ratio based on paper movement through a second number of lines of printing, less than the first number of lines of printing; and where an indication of a problem with paper movement between the first and second sensors is indicated if the ratio between the long term value of the advance ratio and the short term value of the advance ratio falls outside predetermined upper and lower values. The present invention further provides for the establishment of the long and short term values of the advance ratio during an initial calibration routine.

In one form of movement sensor for the present invention, a single wheel rolls against advancing paper and the rotation detector is coupled to monitor rotation of the wheel. The preferred form of the rotation detector is an optical light transmitting, circular grating which provides a plurality of countable pulses for each line advance by the printer.

The second preferred form of paper movement sensor in the present invention is provided in the form of a first edge wheel and a second edge wheel, each positioned to roll against portions of the advancing paper close to respective edges of the advancing paper. Each edge wheel is provided with a respective edge wheel rotation detector. In each instance the preferred form of edge wheel rotation detector is an optical grating of the same general type used for the single wheel.

The present invention seeks, in addition to detecting errors in the advance of paper in a printer, to detect skew errors where one side of the advancing paper becomes stuck and the paper rotates to adopt an angle other than in the direction of its advance. Accordingly the present invention provides that, if the difference between the sums of the outputs of the edge wheel rotation detectors exceeds a predetermined limit, indication of paper skew, either at the input to the printer or at the output of the printer, will be provided. In order to minimize the effects of tolerance in the diameters of the two edge wheels in the sensor, the invention further provides that a ratio is formed between the sum of the output of a first one of the edge wheel rotation detectors and the sum of the output of a second one of the edge wheel rotation detectors, to provide an edge ratio. The edge ratio is then used to multiply the output of one or other of the outputs of the edge wheel rotation detectors to normalize the sensitivity of both edge wheel rotation detectors such that they are the same for equal advance of paper. The invention further provides that a long term value of the edge ratio is formed based on paper movement through a first number of lines of printing; that a short term value of the edge ratio is formed based on paper movement through a second number of lines of printing, less than the first number of lines of printing; and that paper skew is indicated if the ratio between the long term value of the edge ratio and the short term value of the edge ratio falls outside predetermined upper and lower values. In this way long-term slight movements of paper liable to cause error are detected, while the formation of long term and short term values of measured parameters or ratios, in each instance where such long or short term values are formed, provides a self-calibrating function capable of overcoming long-term wear and short-term perturbations in mechanical parameters.

As with the advance ratio, so initial values of the long term and short term values of the edge ratio are established during a calibration routine. In the present invention, where two sensors are employed, there is of course a first edge ratio for the first sensor and a second edge ratio for the second sensor both treated as above described.

The present invention further provides, that should a ratio between the long-term value of paper advance and a short-term value of paper advance fall outside predetermined limits, a paper movement fault can be flagged, either at the entry to the printer or at the exit of the printer, depending upon where the discrepancy was discovered. Likewise, the present invention also provides for the ratio between the long-term value of output of each edge wheel rotation detector and the short-term value of each edge wheel rotation detector to be formed, and for a skew error to be indicated if the ratio so formed again falls outside a predetermined range of values.

Where a pair of edge wheels are used, the amount of paper advance is taken as the mean value of the individual normalized or un-normalized edge wheel rotation detector outputs (i.e., half the sum of the outputs). In the single wheel sensor, the wheel is provided in the middle of the paper so as to be insensitive to skew. By taking the mean value of the edge wheel rotation detector outputs, an equivalent of central positioning of a single wheel is achieved so far as output sensitivity and insensitivity to skew is concerned.

The paper movement sensor, in each instance, is provided in a housing which comprises a pair of arms. The arms engage some portion of the apparatus associated with the printer. A second housing for the second paper movement sensor has arms which engage the housing for the first paper movement sensor. In this way both paper movement sensors can be hinged independently of the printing apparatus for paper loading. In the preferred embodiment the housing for the first paper movement sensor is identical with the housing for the second paper movement sensor to achieve economy of fabrication. In more complex printers, as many paper movement sensors as are required may be strung together to monitor paper movement at an increased plurality of points.

BRIEF DESCRIPTION OF THE DRAWINGS

The present invention is further explained, by way of example, by the following description taken in conjunction with the appended drawings, in which.

DESCRIPTION OF THE PREFERRED EMBODIMENTS

Figure 1:
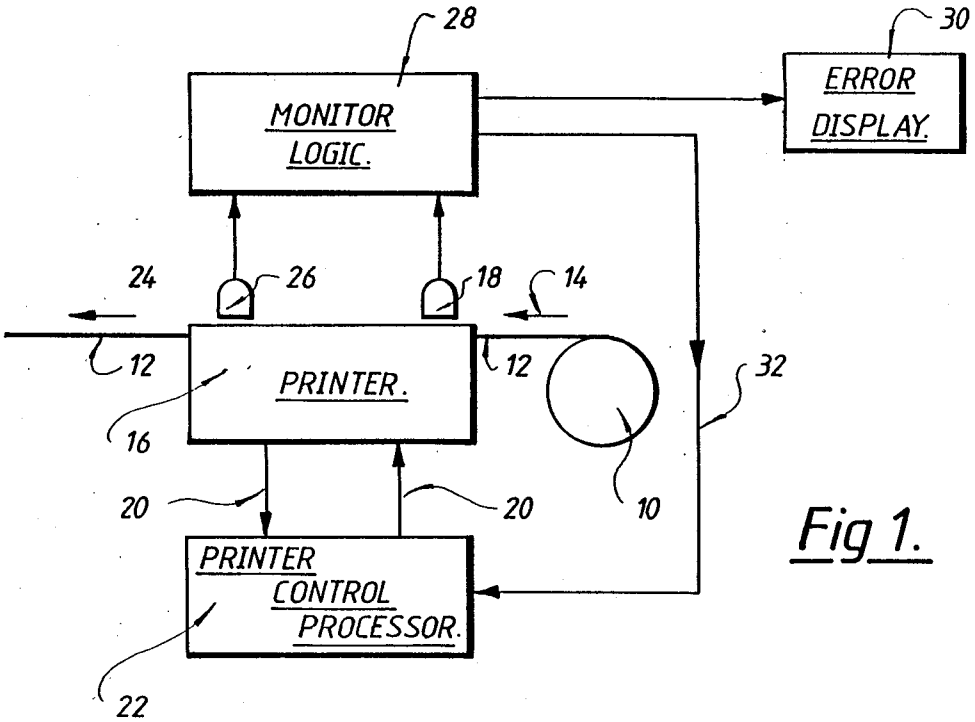
FIG. 1 shows a block diagram of a system wherein the present invention is employed.

A roll of paper 10 feeds a continuous paper web 12 as indicated by the first arrow 14 into a printer 16. A first movement sensor 18 monitors movement of the paper 12 as it enters the printer 16. The printer 16 is controlled via bi-directional printer data path 20 to a printer control processor 22 which responds to outside commands and data to cause the printer 16 to advance the paper 12 and to print visible records thereon.

Having received a printed record the paper 12 exits from the printer 16 as indicated by a second arrow 24. A second paper movement sensor 26 monitors movement of the paper 12 as it exits from the printer 16.

The first 18 and second 26 paper movement sensors provide input to monitor logic 28 which responds to the inputs of the paper movement sensors 18,26 in a manner herinafter described. The function of the monitor logic 28 is to analyzed the outputs of the paper movement sensors 18,26 and to use the analyzed inputs to detect paper movement errors. Should a paper movement error be detected, the monitor logic 28 can provide indication on an error display 30 and can provide output on an inhibition line 32 to cause the printer control processor 22 to modify or cease its printing activity.

The present invention concerns itself with the monitor logic 28 together with the first and second paper movement sensors 18,16.

Figure 2:
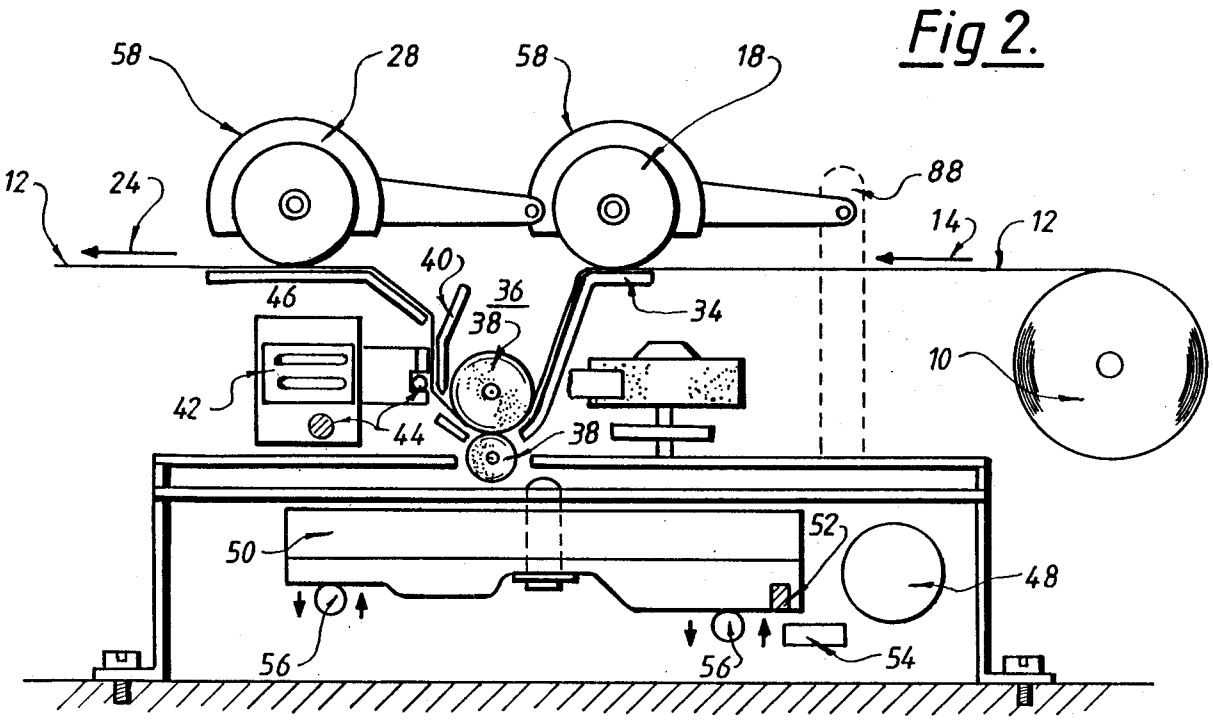
FIG. 2 shows a cross-sectional view of a printer, suitable for use with the present invention, and also shows the positioning of the paper movement sensors.

FIG. 2 is a cross-sectional view of an exemplary printer which can be used with the present invention. It is to be understood that the type of printer shown in FIG. 2 is not restrictive in type so far as the present invention is concerned. The printer of FIG. 2 is shown merely by way of example. FIG. 2 further shows the positions of the first paper movement sensor 18 and of the second paper movement sensor 26.

Paper 12 is fed from the roll 10 over an input platform 34 into a printing well 36 by means of a pair of opposed pinch wheels 38 which grip the paper 12; one of which is driven to cause paper 12 to be advanced. The paper 12 passes from the pinch wheels 38 onto the face of a fixed platen 40. A print head 42 of the dot-matrix variety and supported by a pair of rods 44, generally at 90° to the plane of the paper as shown in FIG. 2, moves to-and-fro along the rods 44 and against the platen 40 to print upon the paper 12. Once printed the paper is moved by the pinch wheels 38 onto an exit platform 46 from which it passes either to a further roll for storage or to an exit slot (neither of which is shown) for retention by a user.

The first paper movement sensor 18 engages the paper 12 at the input platform 34 to trap the paper 12 between itself and the input platform 34. The paper 12 is free to slide against the input platform 34. The second paper movement sensor 26 similarly engages the paper 12 at the exit platform 46.

The overall printer 16 is powered by a motor 48 operative to rotate a cam disc 50 once for every line of printing. The cam disc 50 carries a magnet 52 sensed in a predetermined position by a magnetic sensor 54. When the magnet 52 is again detected by the magnetic sensor 54 a signal is passed to the printer control processor 22 which removes power from the motor 48. During the rotation of the cam disc 50, cam followers 56 are moved up and down by a contoured lower surface of the cam disc 50 to control paper advance by the opposed pinch wheels 38 and movement of the print head 42 across the platen 40. The rotation of the cam wheel 50 causes a first action wherein the paper 12 is advanced by one-line spacing and a second action wherein the head 42 traverses the platen 40. During that time when the head 42 traverses the platen 40 the printer control processor 22 provides control signals to the dot matrix print head 42 so that a desired visible record is left upon the paper 12.

As before stated, the style of printer shown in FIG. 2 is not restrictive with regard to the present invention. The present invention seeks to detect errors in the passage of paper over the input platform 34, errors in the passge of paper over the exit platform 46, and errors wherein paper 12 either accumulates in the printing well 36 or becomes torn in its passage through the printing well 36.

Figure 3:
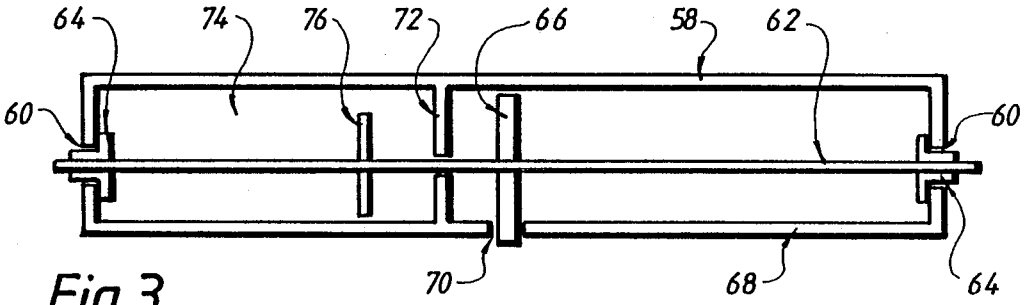
FIG. 3 shows a cross-sectional view of a paper movement sensor employing a single wheel.

FIG. 3 shows a cross-sectional view of one preferred form of the movement sensor or sensors 18,26 otherwise shown in FIGS. 1 and 2.

A sensor housing 58 has shaft apertures 60 at either end thereof wherein a shaft 62 is supported at its extremities by bushes 64. A wheel 66 is provided at the center of the shaft 62 concentrically affixed thereto. The sensor housing 58 is generally enclosed and the wheel 66 protrudes from the lower face 68 of the housing 58 through a wheel aperture 70. The wheel 66 has sufficient clearance from the lower face 68 of the sensor housing 58 to freely roll against paper 12. The sensor housing 58 is fixed relative to the moving paper so that the shaft 62 is at a right angle to the desired direction of movment of paper 12.

An internal wall 72 in the housing 58 through which the shaft 62 passes isolates the wheel 66 from a dust protected chamber 74 wherein is located a photo-optic grating wheel 76 concentrically affixed to the shaft 62 and free to rotate within the dust protected chamber 74. As the paper 12 causes the wheel 66 to rotate, the photo-optic grating wheel 76 rotates by the same amount.

Figure 4:
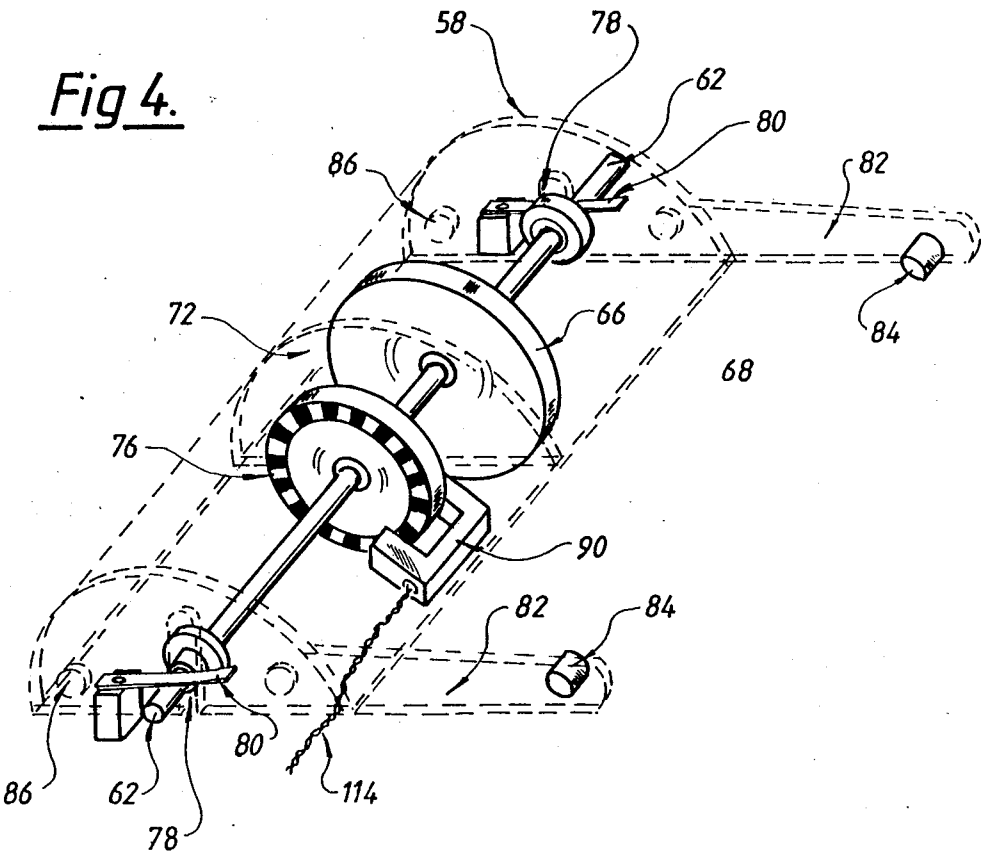
FIG. 4 shows a projected representation of the single wheel paper movement detector of FIG. 3.

FIG. 4 shows a projected view of the paper movement sensors 18,26 of FIG. 3. In FIG. 4 the housing 58 is shown in phantom outline, as if made of transparent material. It is to be understood that the housing 58 can indeed be made of transparent material, but equally it can be made of opaque material without loss of function.

The shaft 62 is held in end slots 78 in the end walls of the housing 58 by means of leaf springs 80 allowing a degree of freedom of movement of the housing 58 relative to the surface of paper 12 so that vertical tolerances (as shown in FIG. 2) can be accommodated without undue friction being applied to the paper 12 against either the input platform 34 or the exit platform 46. The housing 58 is supported by a pair of arms 82, with lugs 84 at the distal ends thereof, capable of engaging a support 88 (shown in phantom outline in FIG. 2) or operative to engage holes or recesses 86 in another housing 58. Thus the first sensor 18 of FIG. 2 engages support means 88 and the second paper movement sensor 28 of FIG. 2 engages the housing of the first paper movement sensor 18. Should further paper movement sensors be required along the exit path of paper 12 they can be attached in a long-chai as indicated in FIG. 2.

Returning to FIG. 4, a photodetector yoke 90 spans the photo-optic grating wheel 76 which is provided with circumferentially equispaced areas of opacity and transparency to light. The photodetector yoke 90 shines light towards the photo-optic grating wheel 76 and detects its passage or non-passage there-through to generate a pulsating electric signal which changes as the wheel 66 rotates, and where each pulse represents a predetermined distance of movement of paper 12 beneath the wheel 66.

Figure 5:
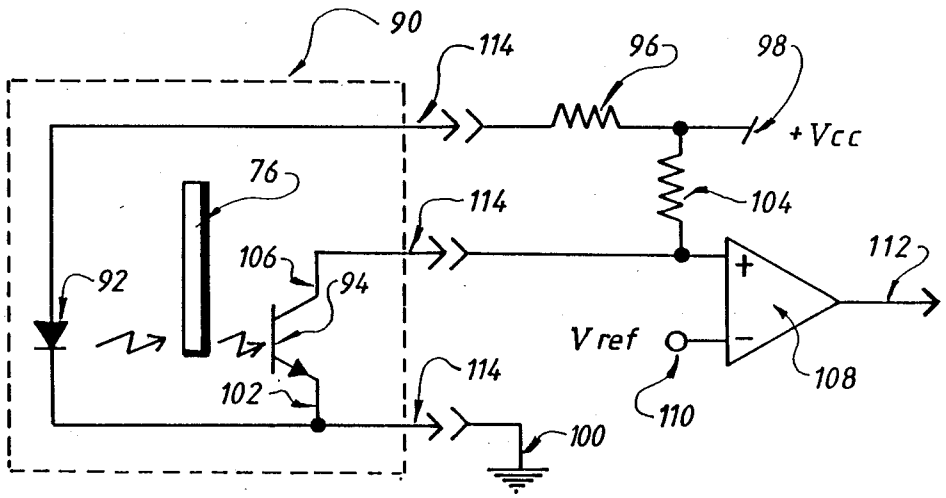
FIG. 5 shows a schematic diagram of photo-electric rotation detector suitable for use in conjunction with the wheel rotation detector grating of FIG. 4.

FIG. 5 is a schematic diagram of the electrical circuits associated with the photo-optic grating wheel 76. The photodetector yoke 90 comprises a light emitting diode 92 or other light sourceshining light towards the photo-optic grating wheel 76. Light passing through the photo-optic grating wheel 76 is intercepted by a phototransistor 94. A first resistor 96 regulates electrical current from a supply rail 98 through the light emitting diode 92 whose other terminal is connected to a ground 100. The emitter 102 of the phototransistor 94 is also connected to the ground 100. A second resistor 104 provides a load to the collector 106 of the phototransistor 94 to develop a voltage responsive to the amount of light incident upon the phototransistor 94. The collector 106 of the phototransistor 94 is connected to a first input terminal of a voltage comparator 108 and a second input terminal of the voltage comparator 108 is connected to a reference voltage source 110. If the voltage on the collector 106 of the phototransistor 94 exceeds the value of the reference voltage source 110 an output 112 of the comparator 108 provides a logic signal of a first polarity, and if the voltage on the collector 106 of the phototransistor 94 is less than the value of the reference voltage source 110, the output 112 of the comparator 108 provides a logic signal of the opposite polarity. As the wheel 66 rotates, the comparator 108 thus provides as output 112 a succession of alternating polarity logic pulses. The phototransistor 94 and the light emitting diode 92 are generally contained in the photodetector yoke 90. The comparator 108 resistors 96,104 and supplies 98,110,100 are generally provided by the monitor logic 28. Connecting wires 114 connect the photodetector yoke 90 to the monitor logic 28.

The electrical circuit shown in FIG. 5 is given only by way of example. It is to be understood that many other forms of electrical circuit can be used with equal success by the photodetector yoke 90 and monitor logic 28, and each different form of circuit is equally applicable in the present invention. It is only necessary that output be provided in response to rotation of the wheel 66. As well as other photo-optic rotation detectors known in the art, the present invention also provides that magnetic rotation sensors and integrating tachometers can be used to detect rotation of the wheel 66. Those skilled in the art will be aware of other means whereby rotation of the wheel 66 can also be detected, each of which other means can be applied in the present invention.

Figure 6:
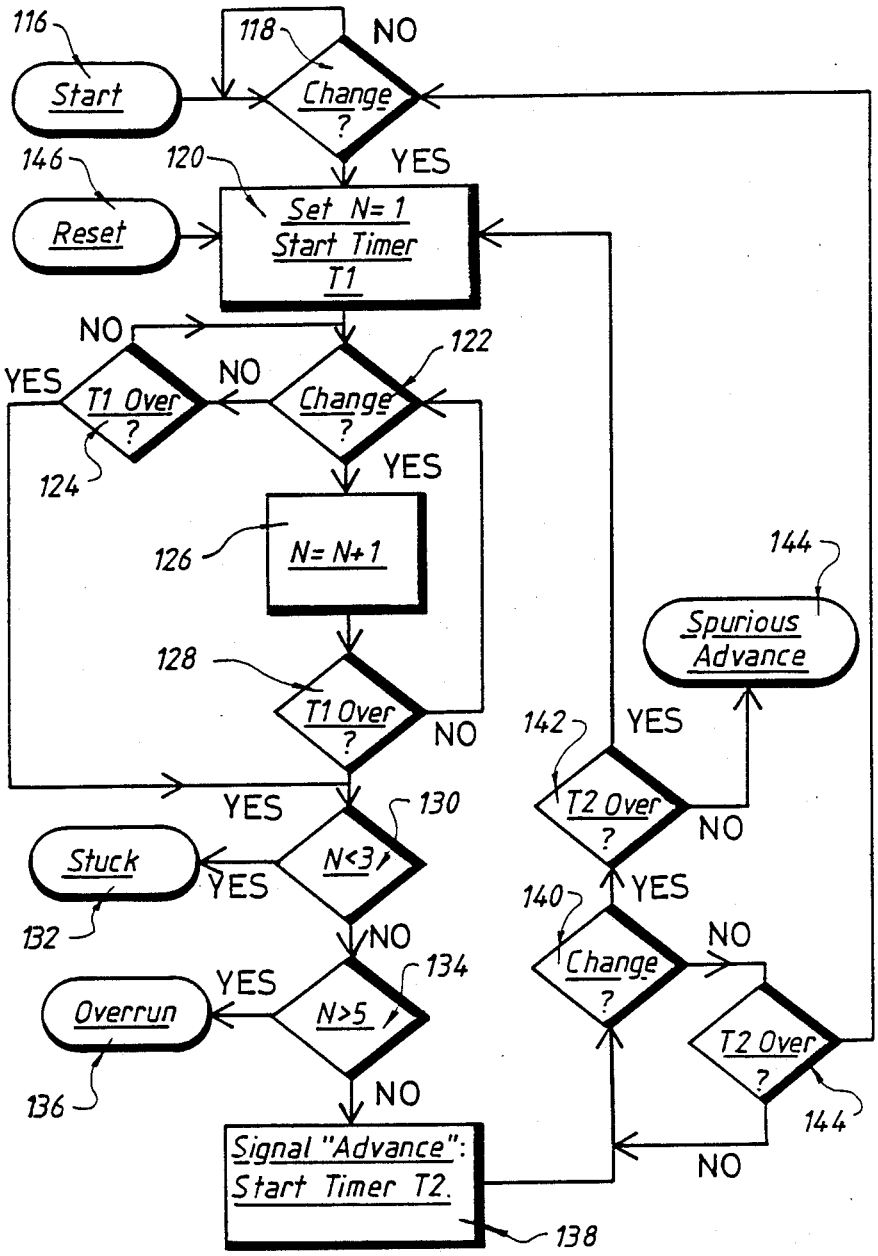
FIG. 6 is a flow chart indicating a first level of activity of the monitor logic of FIG. 1 where gross and near-instantaneous paper movement errors are detected.

FIG. 6 is a flow chart of the activities of the monitor logic 28 in detecting instantaneous paper movement problems using the information available from a paper movement sensor 18,26 as shown in FIGS. 3, 4 and 5.

When the monitor logic 28 is operational it enters the routine shown in FIG. 6 via a start instruction 116. A first test 118 is then performed to see if the logio output 112 of the comparator 108 has changed. If no change has occurred the first test 118 is repeated until a change in the logic output 112 is detected. If a change in the logic output 112 of comparator 108 is detected the first test moves to a first operation 120 wherein a running count of the number of changes N to the output 112 of the comparator 108 is set to unity vlue. At the same time a first timer T1 commences its operation. Thereafter the first operation 120 passes control to a second test 122 which also looks for a change in the logic output 112 of the comparator 108. If no change is perceived, the second test 122 passes control to a third test 124 which tests to see if the period of the first timer T1 has expired. If the period of the first timer T1 has not expired control is passed back to the second test 122. If the second test 122 perceives a change in the logic output 112 of the comparator 108, control is passed to a second operation 126 whereat the running count N of pulses from the logic output 112 of the comparator 108 is incremented by one. The second operation 126 then passes control to a fourth test 128 which tests to see if the period of the first timer T1 has expired. If the period of the first timer T1 has expired, control is passed to a fifth test 130. If the period of the first timer T1 has not expired, control is passed back to the second test 122, seeking further change in the logic output 112 of the comparator 108. If, during waiting for a change in the logic output 112, the third test 124 detects that the period of the first timer T1 has expired, control is also passed directly to the fifth test 130.

The period of the first timer T1 is chosen to be slightly in excess of the time required for the cam disc 50 to move one of the cam followers 56 to cause the pinch wheels 38 to move the paper 12 through one line spacing. In this example the frequency of the alternate light and dark patterns on the photo-optic grating wheel 76 is chosen such that at least three and no more than five pulses should be provided by the output 112 of the comparator 108 during a movement of paper. The target value for a line shift is in fact, in this example, chosen to be four pulses. In practice the first pulse may just have been provided during the previous line shift and thus be omitted. Alternatively, a further pulse may just happen at the end of a line shift because of lack of any phase integrity between the pulses and the line shifts. Thus, the target value of four may lack a pulse or may acquire an additional pulse. A valid line shift is thus taken as being any number of pulses between one more and one less than the target value.

The fifth test 130 tests to see if the running count N during the line shift was less than three pulses. If the running count was less than three pulses, an exit is made via a 'stuck' routine 132 which will indicate that the paper 12 has moved less than the desired value of pulses during a line shift, and which commands the appropriate action from the error display 30 and the printer control processor 22. If the fifth test 130 indicates that three or more pulses have been detected on the output 112 of the comparator 108, control is passed to a sixth test 134 which tests whether or not more than five pulses were obtained in the running count. If more than five pulses were obtained in the running count, control is passed to an 'overrun' routine 136 where indication is provided that some agency has caused more paper to be fed during a line shift than should be expected. This comes about because of other equipment or persons tugging upon the paper 12, or can occur should paper become wrapped round either of the pinch wheels 38. The 'overrun' routine 136 prompts the appropriate response from the error display 30 and provides appropriate input to the printer control processor 22.

If the sixth test 134 detects that five or fewer pulses were obtained in the running count N, control is passed to a third operation 138 where, if desired, a signal is sent to the printer control processor 22 indicating that the correct 'advance' has been achieved and where a second timer T2 is started.

The period of the second timer T2 is slightly longer than the time required for the print head 42 to traverse the platen 40 to print a line of printing. It is important that during this period the paper should not advance. Accordingly the third operation 138 passes control to a seventh test 140 which looks for change in the output 112 of the comparator 108. If no change is instantly detected, the seventh test 140 is repeated. If change is detected by the seventh test, control is passed to an eighth test 142 to see if the period of the second timer T2 has expired. If the period of the second timer T2 has not expired, the routine exits via a 'spurious advance' routine 143 which indicates to the error display 30 and the printer control processor 22 that spurious advance during printing has taken place. Should the eighth test 142 indicate that the period of the second timer T2 has expired, control is passed directly to the first operation 120. A ninth test 144 modifies the seventh test 140 such that control is passed directly to the first test 118 should the seventh test 140 detect no change before the period of the second timer T2 has expired.

It is to be understood that the routine indicated in FIG. 6 is executed for the first paper movement sensor 18 where it alone is provided, and for both the first paper movement sensor 18 and the second paper movement sensor 28 in a system where both are provided. It is also to be understood that, the count N of FIG. 6 which is here indicated as being the raw number of changes of the output 112 of the comparator 108, can be a modified or normalized count obtained by methods hereinafter to be described. Those skilled in the art will be aware of how the second operation 126 can be caused to make the running count N a normalized value rather than the sum of raw counts. This is achieved by multiplying the actual sum of counts by a correcting factor whose derivation is hereinafter explained.

With regard to FIG. 6, should the printer 16 have been stopped for any reason or the paper 12 changed or a jam or paper tear cleared, it will be desired to restart the printer. To this end, when a reset button (not shown) is pressed a reset operation 146 causes entry directly to the first operation 120.

When both the first 18 and second 26 paper movement sensors are present, the monitor logic 28 provides for detection of short term errors of movement within the printing well 36 of the printer 16. If the first paper movement sensor 18 produces a normal count and the second paper movement sensor 26 produces a low count, paper is accumulating in the printing well 36. Indication is provided thereby not only of paper being stuck (from either of the paper movement sensors 18 or 26) but also where the paper 12 is becoming stuck. If the second paper movement sensor 26 shows a normal count and the first paper movement sensor 18 shows a low count, there having been no previous indication of error, it is indicative of the paper 12 having become torn in the printing well 36. In other words, if there is a difference between the counts obtained by the first paper movement sensor 18 and the second paper movement sensor 26 a clear indication of anomylous paper movement within the printing well 36 is provided. In particular, the monitor logic 28 of the present invention is operative to maintain a running count over several lines for each of the first paper movement sensor 18 and the second paper movement sensor 26 and, should the difference in the running count exceed predetermined limits, to flag an appropriate error indicative of anomylous movement of paper in the printing well 36. Not shown in FIG. 6, but equally within the scope of the present invention, is the activity of the monitor logic 28 when no count at all is obtained from either of the first paper movement sensor 18 or the second paper movement sensor 26. If the zero count is obtained from both sensors 18,26 together, the monitor logic 28 indicates a condition which can either be lack of paper 12 or a total jam. If only the first paper movement sensor 18 indicates zero movement the monitor logic 28 provides indication to the error display 30 and to the printer control processor 22 that a condition exists either where a paper break has occurred in the printing well 36 or where the roll 10 of paper 12 is exhausted. An indication of simply paper exhaustion is provided if the monitor logic 28 detects a zero count from a first paper movement sensor 18 immediately subsequently to a lower count from the first paper movement sensor 18. If the zero count is obtained only from the second paper movement sensor 26, the monitor logic 28 provides output to the error display 30 and to the printer control processor 22 indicative of a paper break either in the printing well 36 or on the platen 40.

The invention, as so far described, relates to the detection of short-term detectable or instantaneous errors in paper feed in the printer 16. The present invention also addresses itself to detecting skew conditions where the direction of travel of paper 12 becomes twisted or altered.

Figure 7:
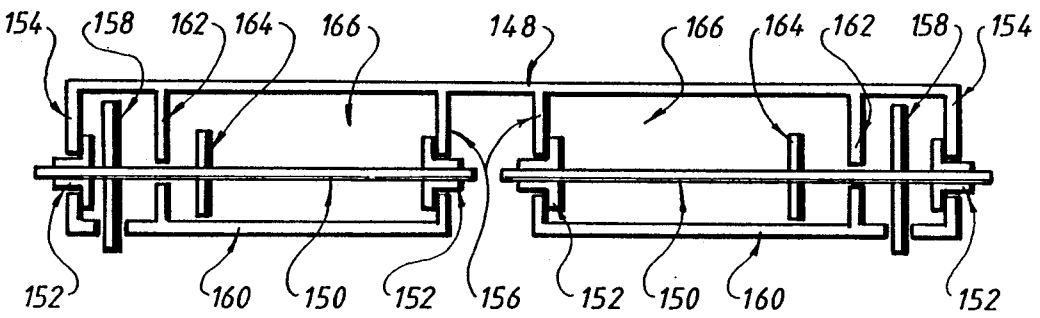
FIG. 7 shows a cross-sectional view of a paper movement sensor employing a pair of edge wheels.

FIG. 7 shows a cross-sectional view of a sensor 18,26 according to a second preferred embodiment thereof.

A housing 148 is provided, having the same general external outline shown as the housing of FIG. 4, but wherein the shaft 62 of FIG. 4 is replaced by a pair of aligned half-shafts 150 each extending a little less than halfway across the second housing 148 and supported by bushes in apertures in external walls 154 of the second housing 148 and in internal support walls 156. Edge wheels 158 protrude through respective bottom faces 160 of the second housing 148 to roll against paper 12. Dividing walls 162 separate the edge wheels 158 from photo-optic wheels 164 which are each situated in a dust protected chamber 166, one at either end of the second housing 148. The edge wheels 158 are each capable of independent free rotation with respect to the other. Each photo-optic wheel 164 is provided with a photodetector yoke 90, now shown, and the circuitry shown in FIG. 5 to allow interfacing to the monitor logic 28.

With regard to FIG. 7, the monitor logic 28 performs additional functions to detect skew of the paper. If either of the edge wheels 158 produces an incorrect count (in this instance, for preference, either less than three pulses or more than five pulses) as the paper 12 moves, the monitor logic 28 indicates to the error display 30 and to the printer control processor 22 that the paper has skewed towards a direction of travel tending towards that side whereat is situated the particular one of the edge wheels 158 causing the lower count. Similarly, as with the single wheel 66, the monitor logic 28 is also operative to maintain a running sum of the counts obtained from the respective edge wheel photo-optic wheels 164. If the running sum should display a difference of a predetermined number of lines having a magnitude greater than the predetermined limit, indication of skew in the direction of lesser count is provided to the error display 30 and the printer control processor 22.

The single wheel paper movement sensor shown in FIG. 3 can be replaced in either or both positions shown in FIG. 2 by the dual edge wheel paper movement sensor shown in FIG. 7. When a single wheel 66, paper movement sensor 18,26 is so replaced, the monitor logic 28 must replace the skew-free output from the single wheel 66 (lying in the centre of the paper) with an indication of equivalent merit (i.e. skew-free) derived from the two edge wheel photo-optic wheels 164. To do this the monitor logic 28 performs the following calculation:

Let e1=Instantaneous count of Left Edge wheel 158 in first sensor 18:

Let e2=Instantaneous count of Right Edge wheel 158 in first sensor 18:

Let e3=Instantaneous count of Left Edge wheel 158 in second sensor 26:

Let e4=Instantaneous count of Right Edge wheel 158 in second sensor 26:

Let a1=Instantaneous advance count of paper found by first sensor 18:

Let a2=Instantaneous advance count of paper found by second sensor 26:

Where 'instantaneous' means 'for each line of paper advance' then $$a1 = \frac{e1 + e2}{2}$$

and $$a2 = \frac{e3 + e4}{2}$$

where it is understood that e values and a values can be normalized as hereinafter and hereinbefore described.

The instantaneous advance counts or count found in the above calculations are then used in the routine of FIG. 6, and in all routines described in connection with FIG. 6 and the operation of the monitor logic 28, which would otherwise be used for a sole wheel 66 count. Since the edge wheels 158 are symmetrically placed with respect to the edges of the paper 12, the derived counts a1 and/or a2 display no skew. The symmetry of the edge wheels 158 ensures that any skew increasing the count on one edge wheel 158 will decrease the count on its partner edge wheel 158 so that their sum remains constant.

Figure 8:
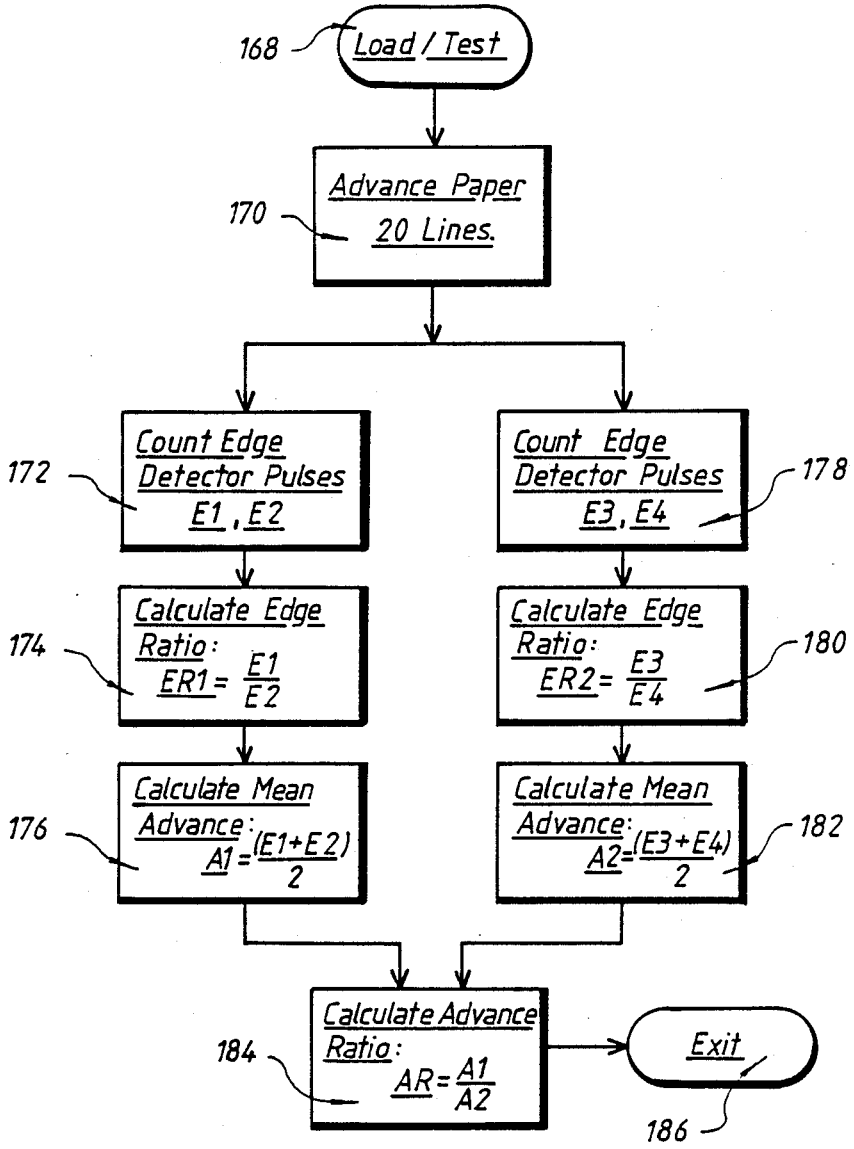
FIG. 8 is a flow chart indicating the initial calibration routine, used to establish long and short term values of different ratios and parameters, and particularly directed towards those circumstances where the sensor shown in FIG. 7 is employed.

FIG. 8 shows a flow chart of the manner in which apparatus of the present invention self-calibrates in order to accommodate detection of long-term paper feeding errors with precision. The routine shown in FIG. 8 permits the differences in diameters between wheels 66,158 to be accommodated, and even allows for different numbers of pulses per unit angle of rotation from the photo-optic grating wheels 76 and the photo-optic wheels 164 to be accommodated.

A start-up instruction 168 is issued whenever fresh paper 12 is loaded or whenever it is desired to test or recalibrate the system. The start-up instruction 168 can originate from the printer control processor 22 or can be initiated by push button switch used by an operator.

The start-up instruction 168 immediately passes control to a fourth operation 170 where the printer control processor is commanded to cause the paper 12 to be advanced by a predetermined number of lines. In this instance the number of lines chosen is twenty. For greater precision a greater number of lines is chosen and, if less precision is acceptable, a lesser number of lines is chosen. The number here chosen is by way of example only.

The routine shown in FIG. 8 is demonstrative of the situation where both the first paper movement sensor 18 and the second paper movement sensor 26 are of the type illustrated in FIG. 7. In the routine shown in FIG. 8 accumulated sums of pulses from four edge wheels 158 are made and manipulated. It is to be understood that should one or other of the paper movement sensors 18,26 be of the type shown in FIG. 3, the edge wheel derived pulse counting routine is omitted for that sensor of the type shown in FIG. 3 and the mean advance of the wheel 66 used instead in all calculations.

The fourth operation 170 passes to two simultaneously executed chains of operation. In a first chain the pulses derived from the photo-optic wheels 164 associated with individual edge wheels 158 of the first paper movement sensor 18 are counted in a fifth operation 172. The fifth operation 172 passes through a sixth operation 174 wherein the edge ratio of the first paper movement sensor 18 is calculated by taking the ratio between the accumulated counts derived from the lefthand photo-optic wheel 164 and the accumulated counts derived from the righthand photo-optic wheel 164. The sixth operation 174 passes control to a seventh operation 176 where the mean advance of the first paper movement sensor 18 is calculated.

At the same time as control is passed to a fifth operation 172, a second chain of operations, calculating the edge ratio and the mean advance for the second paper movement sensor 28, is accomplished in a eighth operation 178 corresponding to the fifth operation 172, in a ninth operation 180 corresponding to the sixth operation 174, and in a tenth operation 182 corresponding to the seventh operation 176. Thus the edge ratio and the advance are worked out for both the first paper movement sensor 18 and the second paper movement sensor 26 over a large number of advanced lines of printing.

Finally, the results of the tenth operation 182 and of the seventh operation 176 are combined in the eleventh operation 184 where an advance ratio is calculated for the two paper movement sensors 18,26. The exact albegraic relationship between the variables is explained below. Once the eleventh operation 184 has been completed the routine of FIG. 8 exits to further operation via an exit routine 186.

The calculations are made as follows:

Advance the paper M lines.

Let E1=accumulated count from Left Edge wheel 158 of first sensor 18:

Let E2=Accumulated count from Right Edge wheel 158 of first sensor 18:

Let E3=Accumulated count from left Edge wheel 158 of second sensor 26:

Let E4=Accumulated count from Right Edge wheel 158 of second sensor 26:

To calculate edge ratio of first sensor 18 (ER1):

$$ER1 = \frac{(E1)}{(E2)}$$

To calculate edge ratio of second sensor 26 (ER2):

$$ER2 = \frac{(E3)}{(E4)}$$

To calculate accumulated advance of first sensor 18 (A1):

$$A1 = \frac{(E1 + E2)}{2}$$

To calculate accumulated advance of second sensor 26 (A2):

$$A2 = \frac{E3 + E4}{2}$$

To calculate advance ratio (AR) for whole system $$AR = \frac{A1}{A2}$$

The edge ratios ER1,ER2 reflect the ratio in counts derived from the edge wheels of the FIG. 7 embodiment of the movement sensors 18,26. The edge ratios are used to correct errors between counts induced by different spacial rates of dark and light areas on the photo-optic wheels 164 and caused by differing diameters of the edge wheels 158. The calculations made by the monitor logic 28 are as follows:

Corrected value of E2=E2.ER1=E1

Corrected value of E4=E4.ER2=E3

Likewise the advance ratio AR is used to correct errors and differences in count of mean advance so that differences in subsequent advances can be detected.

Corrected value of A2=A2.AR=A1

It is to be recalled that the corrected values of E2 and E4 are only identical to E1 and E3 respectively over the long period of paper advance during the calibration routine. In the short term, should any error occur, the corrected value (corrected by the long term advance ratio or edge ratio discovered during calibration) will deviate from equality with the other parameter used to calculate the correction ratio (ER1,ER2,A1).

The advance ratio AR, and the edge ratios ER1,ER2 could equally have been calculated as the inverse ratios to those shown in which case the correction would have been caused in one instance by multiplying E1 by ER1, in another by multiplying E3 by ER2, and in a final instance by multiplying A1 by AR.

In the routine of FIG. 8 while the mean advance is here shown as being calculated using the raw value of E1 or the raw value of E3, it is to be understood that the mean advance can be calculated using the corrected values of E1 and the corrected values of E3.

Figure 9:
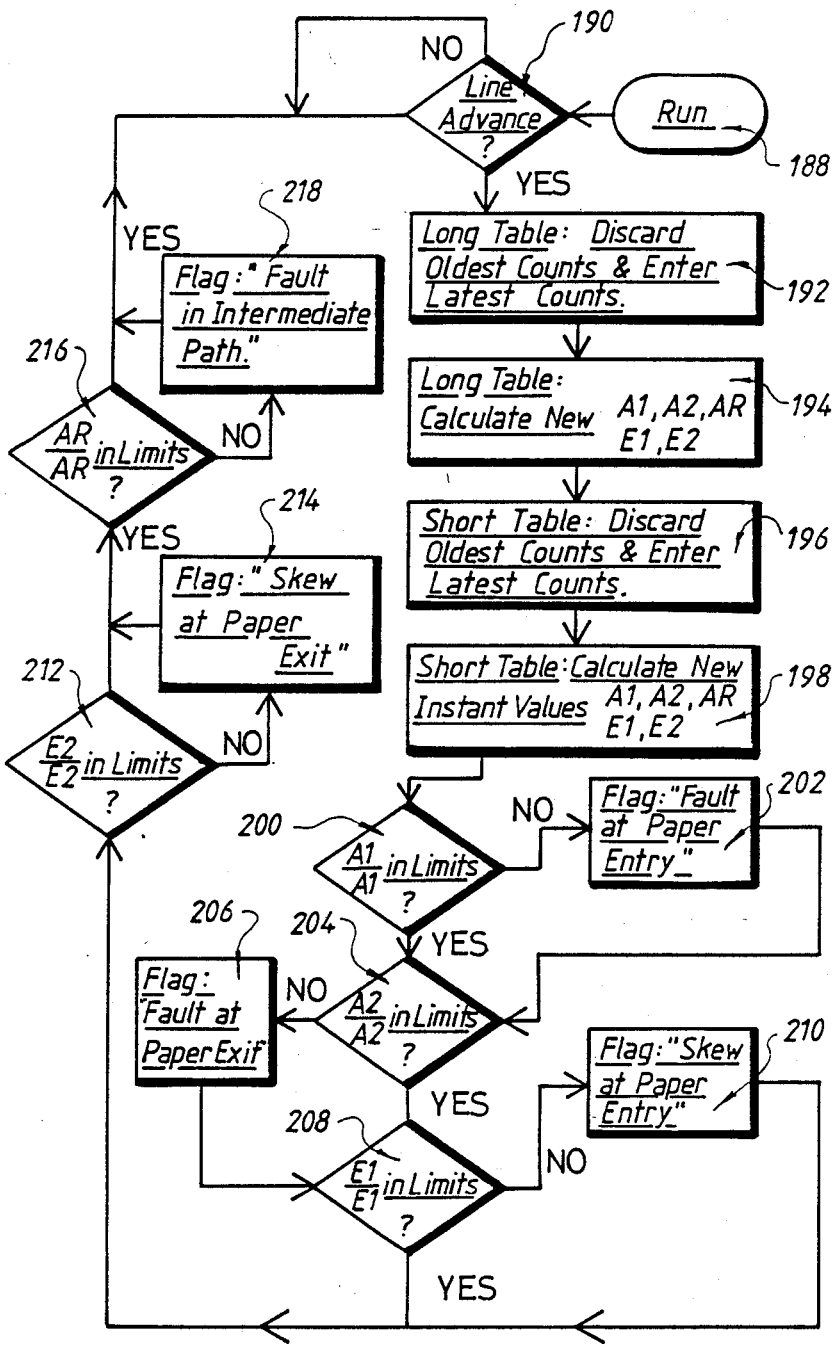
FIG. 9 is a flow chart indicating how the monitor logic of FIG. 1 performs a continuous self-calibrating function, and further detects long-term paper movement errors.

The initial calibration of the system is established, using the routine shown in FIG. 8. FIG. 9 illustrates how the system continues to self-calibrate during use, and how deviations from normal values are detected.

FIG. 9 is entered via a run instruction 188 subsequent to the exit instruction 186 of FIG. 8. Control is passed immediately to a tenth test 190 which checks the output of the photodetector yokes 90 to see if a line advance has been achieved. If a line advance has been achieved control is passed to a twelfth operation 192 which maintains a long table of values found in line advances.

The long table comprises a list of all of the values of counts derived from all of the photo-optic wheels 164 (alternately 76 where appropriate) over a predetermined number of line advances of the paper 12. When the new value of count for each photo-optic wheel 164 (or 76) is received, that value of count corresponding to the particular photo-optic wheel 164 (or 76) which has been longest on the table is discarded. All of the other values are moved up one place and the new value stored as the earliest value. This is a standard stack operation. Thus, at each instance of line advance during the operation of the printer 16, a fresh 'running average' assessment of the performance of the monitoring system is provided.

The twelfth operation 192 passes control to a thirteenth operation 194 where new values of the mean advance A1 detected by the first paper movement sensor 18, the mean advance A2 detected by the second paper movement sensor 26, the advance ratio AR, the edge ratio E1 of the first paper movement sensor 18 and the edge ratio E2 of the second paper movement sensor 26, are calculated. Calculation is achieved as earlier described in relation to FIG. 8. Corrections to the E2 and E4 values and to the A2 values are made as before. Thus a complete new set of ratios AR,E1,E2 and advances A1,A2 are calculated based on a first large predetermined number of line advances for each instance of line advance of the paper 12.

The thirteenth operation 194 passes control to a fourteenth operation 196 wherein a short table is maintained and updated in the same way that the long table was maintained and updated by the twelfth operation 192. That is to say, a shorter table, for example, consisting in the accumulated pulses received from each photo-optic wheel 164 (or 76 where appropriate) for the previous five lines, has the longest-present individual line count for each photo-optic wheel 164 (or 76 as appropriate) discarded, all accumulated values moved up one place, and the latest received count for one line advance stored in the position for the youngest value.

The fourteenth operation 196 passes control to a fifteenth operation 198 wherein a calculation of a short term advance A1′ of the first paper movement sensor 18, a calculation of the advance A2′ of the second movement sensor 26, a calculation AR′ of the advance ratio based on the short table, a calculation of the edge ratio E1′ based on the short table for the first paper movement sensor 18, and a calculation of the edge ratio E2′ based on the short table for the second paper movement sensor 26, are all made.

In this way, two values of each of the calculated advances ratios are maintained. The first value is a long term running average over very many lines of paper advance. The second value in each instance is a short term value based on relatively few lines of paper advance. Statistical perturbations and temporary false counts are unable to significantly alter the calculated values of advance and ratios based on the long table whereas any fault which persists for relatively few lines will be detected by alteration in calculated advance and ratio values from the short table. The correction of any count is achieved using only the ratio (AR,E1,E2) discovered from the long table. The short table is thus incapable of masking paper movement errors since its correction ratios (AR′,E1′,E2′) are not used for correcting the counts (as discussed in connection with FIG. 8). Thus the long table has control over all corrections and the short table merely reflects instantaneous actual conditions.

While the long table is conveniently made equal in the number of line advances to the number of line advances exhibited in the fourth operation 170 (herein chosen for exemplary purposes as being 20-line advances), there is no necessity for the two numbers of line advances to be equal. The initial calibration routine shown in FIG. 8 can be used as a starting point for a much larger table used in the routine shown in FIG. 9. For example, the initial twenty lines shown in FIG. 8 can be made perhaps one hundred lines (for example) simply by adding to the long table, starting with only twenty values as each line advance is achieved until a total of one hundred values is achieved in the long table. Once the long table has been filled the routine shown in FIG. 9 commences for the first time to discard the longest retained count values for each line. Thus, a short start-up routine as illustrated in FIG. 8 can be used to seed a longer start-up routine as illustrated in FIG. 9.

It is also provided in the present invention that an initial set of values found in the initial calibration routine of FIG. 8 can be stored in a non-volatile manner in the monitor logic 28 so that, should it for any reason not be desired to waste twenty lines or so of paper (or any other length of paper as may be considered convenient for the calibration routine of FIG. 8) the values found on a previous occasion and not discarded when the equipment was switched off, are used to seed the routine of FIG. 9. Once the routine of FIG. 9 has been running for some little time, the stored values are discarded from the calculations and a true picture of the running of the monitor 18,26,28 is achieved.

Once the fifteenth operation 198 passes the control to an eleventh test 200 wherein the ratio between the paper advance A1' for the first document movement sensor 18 for the short table and the advance A1 for the first paper movement sensor 18 from the long table is compared with the predetermined limits. If the value of the ratio of the eleventh test 200 falls outside an upperbound or a lowerbound (i.e. it is not within predetermined limits) operation is transferred to a sixteenth operation 202 wherein indication is provided of a fault existing at paper entry. If the ratio is less than a lowerbound, accumulated paper, tearing in the printing well 36, or slipping of the pinch wheels 38, or depletion of the supply of paper 12 is indicated. If the ratio found in the eleventh test 200 exceeds an upperbound, anomylous paper feeding conditions in the printing well 36 are indicated, such as the paper 12 becoming wrapped round one of the pinch wheels 38, or the pinch wheels 38 failing over time to grip the paper sufficiently to restrain the paper 12 being pulled through the printer 16 by some outside means.

If the ratio from the eleventh test 200 is within its limits, control is passed to a twelfth test 204. The sixteenth operation 202 also passes control to the twelfth test 204. In the twelfth test 204 the ratio is taken between the value of the paper advance A2' found from the short table for the second paper movement sensor 26 and the value of advance A2 found for the second paper movement sensor 26 from the long table, and tested to see if it lies between predetermined limits, that is to say, between an upperbound and a lowerbound. If the ratio found in the twelfth test 204 is not within its predetermined limits, control is passed to a seventeenth operatio 206 where indication is provided to the error display 30 and to the printer control processor 22 that an accumulated paper movement fault has been discovered at the paper exit. If the ratio found in the twelfth test 204 is less than its lowerbound, the seventeenth operation 206 provides indication of paper tearing or paper jamming or accumulation within the printing well 36 after the pinch wheels 38. If the short fall in paper movement was discovered both by the eleventh test 200 and the twelfth test 204 a general jamming condition is indicated by the seventeenth operation 206. Alternatively, under these circumstances the seventeenth operation 206 can indicate a possible depletion of paper supply. If the ratio tested in the twelfth test 204 exceeds is upperbound, the seventeenth operation 206 provides indication that unduly rapid paper feed has been experienced by the second paper movement sensor 26. If the eleventh test 200 has previously also detected unduly rapid paper movement, the seventeenth operation 206 provides indication that some external agency is puling the paper 12 from the printer 16 and that the pinch wheels 38 are unable to resist the pull.

If the twelfth test 204 finds its parameter within its predetermined limits, control is passed to a thirteenth test 208. Likewise the seventeenth operation 206 passes control to the thirteenth test 208. Here the ratio between the edge ration E1' found for the first paper movement sensor 18 from the short table and the edge ratio E1 found for the first paper movement sensor 18 from the long table is tested to see if it lies between predetermined limits. If the ratio found by the thirteenth test lies outside of its predetermined limits, control is passed to an eighteenth operation 210 wherein the motor logic 28 indicates to the error display 30 and to the printer control processor 22 that an accumulated paper skew has occurred at the input platform 34.

If the ratio found in the thirteenth test 208 is within its predetermined limits, control is passed to a fourteenth test 212. The eighteenth operation 210 also passes control to the fourteenth test 212.

The fourteenth test 212 tests the ratio between the edge ratio E2' found for the second paper movement sensor 26 from the short table and the edge ratio E2 found for the second paper movement sensor 26 from the long table lies within predetermined limits. If the ratio found in the fourteenth test 212 lies outside its predetermined limits, control is passed to a nineteenth operation 214 wherein the monitor logic 28 indicates to the error display 30 and to the printer control processor 22 that an accumulated paper skew has appeared at the exit platform 46. If the thirteenth test 208 and the fourteenth test 212 have each indicated an apparent paper skew both to the same side, the nineteenth operation 214 indicates that the paper 12 for some reason has moved across the printer 16 to one side. This can happen, for example, when the paper roll 10 is inadvertently placed to one side of its central position.

If the ratio found in the fourteenth test 212 is within its limits, control is passed to a fifteenth test 216. The nineteenth operation 214 also passes control to the fifteenth test 216. The fifteenth test 216 takes the ratio between the advance ratio AR' found for the whole system (according to the description associated with FIG. 8 herein) from the short table, and the advance ratio AR found for the whole system from the long table, and tests to see if it is within predetermined limits. If it is not within predetermined limits, control is passed to a twentieth operation 218 where the monitor logic 28 provdes indication to the error display 30 and to the printer control processor 22 that a error in paper feed has occurred concerning the mutual rate of movement detection measured between the first paper movement sensor 28 and the second paper movement sensor 26.

If the ratio tested in the fifteenth test is found to be within its predetermined limits, control is passed to the tenth test 190. Likewise, the twentieth operation 218 also passes control back to the tenth test 190.

The routine carried out according to FIG. 9 is thus a very sensitive test of accumulated paper feeding errors within a paper movement monitoring system. Long term changes, such as wear in wheel diameter, accumulation of debris etc. can be accommodated since the system is continuously self re-calibrating. Should, for example, a piece of paper for some reason adhere to one of the wheels, provided that the change in wheel diameter was not large enough to cause fault indication, the change in the wheel diameter would rapidly become transparent in later operation. Likewise, should for any reason the pinch wheels 38 change their diameter (or, for that matter the size of the line feed alter) the system itself re-calibrates very rapidly to make the line length transparent. In particular, the system such as is described, can be applied to virtually any printer with any line length, the routines associated with FIGS. 8 and 9 ensuring that transparency of operation is rapidly achieved regardless of the individual parameters of the printer.

The individual features of novelty hereinbefore described may be applied singly or in any combination in the embodiments of the present invention.

I claim:

1. An apparatus for monitoring movement of paper in a printer, said apparatus comprising a first movement sensor operative to engage paper in a printer at a first point and operative to detect the distance moved by the paper at said first point between successive lines of printing, said apparatus providing indication of a paper feed error if said distance of movement detected by said first sensor does not lie within first and second predetermined limits.

2. An apparatus according to claim 1 including a second movement sensor operative to engage paper in a printer at a second point and operative to detect the distance moved by the paper at said second point between successive lines of printing, said apparatus being operative to make a first sum of the distance detected by said first sensor, to make a second sum of the distance detected by said second sensor, and to provide indication of paper accumulation if the difference between said first sum and said second sum exceeds a predetermined magnitude.

3. An apparatus according to claim 2 wherein said first sensor comprises first rolling means for rolling on advancing paper and a first rotation detection means for providing output indicative of angular movement of said first rolling means; wherein said second sensor comprises second rolling means for rolling on advancing paper and a second rotation detection means for providing output indicative of angular movement of said second rolling means; and wherein said apparatus self-calibrates by making a sum of the output of said first rotation detection means, by making a sum of the output of said second rotation detection means; and by finding the ratio between the sums of said outputs of said first and second rotation detection means to establish an advance ratio.

4. An apparatus according to claim 3 further adapted to multiply said sum of said output of said first or said second rotation detection means by said advance ratio to normalize said outputs of said first rotation detection means with said output of said second rotation detection means.

5. An apparatus according to claim 3 wherein said first rolling means comprises a wheel, and wherein said first rotation detection means comprises a first wheel rotation detector coupled to monitor rotation of said first wheel.

6. An apparatus according to claim 3 wherein said second rolling means comprises a second wheel, and wherein said second rotation detection means comprises a second wheel rotation detector coupled to monitor rotation of said second wheel.

7. An apparatus according to claim 3 operative to form a long term value of said advance ratio based on paper movement through a first number of lines of printing, operative to form a short term value of said advance ratio based on paper movement through a second number of lines of printing, less than said first number of lines of printing, and operative to indicate a problem with paper movement between said first and second sensors if the ratio between said long term value of said advance ratio and said short term value of said advance ratio falls outside predetermined upper and lower values.

8. An apparatus according to claim 3 operative to form a long term sum of said distance detected by said first sensor based on paper movement through a first number of lines of printing; operative to form a short term sum of said distance detected by said first sensor based on paper movement through a second number of lines of printing, less than said first number of lines of printing; and operative to indicate a paper movement fault if the ratio between said long term value of said distance detected by said first sensor and said short term value of said distance detected by said first sensor falls outside predetermined upper and lower values.

9. An apparatus according to claim 7 operative to form a long term sum of said distance detected by said second sensor based on paper movement through a first number of lines of printing; operative to form a short term sum of said distance detected by said second sensor based on paper movement through a second number of lines of printing, less than said first number of lines of printing; and operative to indicate a paper movement fault if the ratio between said long term value of said distance detected by said second sensor and said short term value of said distance detected by said second sensor falls outside predetermined upper and lower values.

10. An apparatus according to claim 3 wherein said first rolling means comprises: first and second edge wheels, spaced transversely to the direction of paper movement, and each operative to engage paper proximately to a respective edge; and a first edge wheel rotation detector for providing output indicative of rotation of said first edge wheel and a second edge wheel rotation detector for providing output indicative of rotation of said second edge wheel.

11. An apparatus according to claim 10 operative to make a sum of rotation indicated by said first edge wheel rotation detector, and operative to make a sum of rotation indicated by said second edge wheel rotation detector and operative to take the ratio between said sum of said output of said first edge wheel rotation detector and said sum of said output of said second edge wheel rotation detector to form a first edge ratio, and therefor operative to multiply an output of said first or second edge wheel rotation detectors to equalize sensitivity therebetween.

12. An apparatus according to claim 11 operative to provide, as said output of said rotation detection means, the mean value of said sum of said output of said first edge wheel rotation detector and said sum of said output of said second edge wheel rotation detector.

13. An apparatus according to claim 11, operative to provide output indicative of paper skew if the difference between said sum of said output of said first edge wheel rotation detector and said sum of said output of said second edge wheel rotation detector exceeds predetermined limits.

14. An apparatus according to claim 11 operative to form a long term value of said first edge ratio based on paper movement through a first number of lines of printing, operative to form a short term value of said first edge ratio based on paper movement through a second number of lines of printing less than said first number of lines of printing; and operative to indicate paper skew if the ratio between said long term value of said first edge ratio and said short term value of said first edge ratio falls outside predetermined upper and lower values.

15. An apparatus according to claim 3 wherein said second rolling means comprises third and fourth edge wheels spaced transversely to the direction of paper movement each operative to engage paper proximately to a respective edge of the paper; and wherein said second rotation detection means comprises a third edge wheel rotation detector for providing output indicative of rotation of said third edge wheel and a fourth edge wheel rotation detector for providing output indicative of rotation of said fourth edge wheel.

16. An apparatus according to claim 15 operative to make a sum of rotation indicated by said third edge wheel rotation detector, and operative to make a sum of rotation indicated by said fourth edge wheel rotation detector.

17. An apparatus according to claim 16 operative to take the ratio between said sum of said output of said third edge wheel rotation detector and said sum of said output of said fourth edge wheel rotation detector to form a second edge ratio, and thereafter to multiply an output of said third or said fourth edge wheel rotation detectors to equalize sensitivity there-between.

18. An apparatus according to claim 17 operative to provide, as said output of said rotation detection means, the mean value of said sum of said output of said third edge wheel rotation detector and said sum of said output of said fourth edge wheel rotation detector and operative to provide output indicative of paper skew if the difference between said sum of said output of said third edge wheel rotation detector and said sum of said output of said fourth edge wheel rotation detector exceeds predetermined limits.

19. An apparatus according to claim 17 operative to form a long term value of said second edge ratio based on paper movement through a first number of lines of printing, operative to form a short term value of said second edge ratio based on paper movement through a second number of lines of printing, less than said first number of lines of printing; and operative to indicate paper skew if the ratio between said long term value of said second edge ratio and said short term value of said second edge ratio falls outside predetermined upper and lower values.

20. An apparatus according to claim 7 wherein said long term and said short term values of said advance ratio are initially established in a calibration routine involving movement of paper through said first number of lines.

21. An apparatus according to claim 8 wherein said long term and said short term sums of said movement detected by said first sensor are initially established in a calibration routine involving movement of paper through said first number of lines.

22. An apparatus according to claim 9, wherein said long term and said short term sums of said movement detected by said second sensor are initially established in a calibration routine involving movement of paper through said first number of lines.

23. An apparatus according to claim 14 wherein said long term and said short term values of said first edge ratio are initially established in a calibration routine involving movement of paper through said first number of lines.

24. An apparatus according to claim 19, wherein said long term and said short term values of said second edge ratio are initially established in a calibration routine involving movement of paper through said first number of lines.

25. An apparatus according to claim 2 wherein said first sensor comprises a first sensor housing for sitting astride the advancing paper in a printer, said first sensor housing comprising a pair of support arms for engaging either side of a printer.

26. An apparatus according to claim 25 wherein said second sensor comprises a second sensor housing for sitting astride the advancing paper, said second sensor housing comprising a pair of support arms for engaging said first sensor housing for said first sensor housing to support said second sensor housing.

27. An apparatus according to claim 26 wherein said second sensor housing is identical in outline to said first sensor housing.

* * * * *